United States Patent [19]

Cooper

[11] 4,295,649

[45] Oct. 20, 1981

[54] TOY MINIATURE VEHICLE RACING GAME

[75] Inventor: Julius Cooper, New Hyde Park, N.Y.

[73] Assignee: Ideal Toy Corporation, Hollis, N.Y.

[21] Appl. No.: 152,904

[22] Filed: May 23, 1980

[51] Int. Cl.[3] ..... A63F 9/14

[52] U.S. Cl. ..... 273/86 B; 46/261; 104/304

[58] Field of Search ..... 273/86 R, 86 B; 46/258, 46/259, 260, 261, 262; 104/60, 295, 296, 304, 305; 238/10 R, 10 E, 10 F

[56] References Cited

U.S. PATENT DOCUMENTS

| | | | |
|---|---|---|---|
| 2,806,323 | 9/1957 | Oback | 273/86 B X |
| 3,206,122 | 9/1965 | Frisbie et al. | 273/86 B |
| 3,324,366 | 6/1967 | Ryan | 273/86 B X |
| 3,466,043 | 9/1969 | McRoskey et al. | 273/86 B |
| 4,078,799 | 3/1978 | Lahr | 273/86 B |
| 4,223,476 | 9/1980 | Meyer | 273/86 B X |

*Primary Examiner*—Anton O. Oechsle

*Attorney, Agent, or Firm*—Richard M. Rabkin

[57] ABSTRACT

A toy vehicle race game is disclosed which includes a relatively flat slotless track having at least two track portions, each of which defines separate paths of travel having inner and outer lanes. The track portions include unobstructed cross-over areas which are located adjacent to each other and define a cross-over being at least four lanes wide through which toy vehicles may pass from one track portion to another. The toy vehicles used in the game include a pair of controllable toy vehicles which can be selectively and independently controlled to cause them to switch lanes within a track portion and to cross from one track portion to another at the cross-over. A drone vehicle is also provided which is restrained for movement in one of the lanes of one track portion, thereby to provide an obstacle to vehicles crossing from one track portion into another. Accordingly, the players must control their controllable vehicles to switch from one track portion to another without colliding with the restrained drone car.

16 Claims, 5 Drawing Figures

FIG. 1
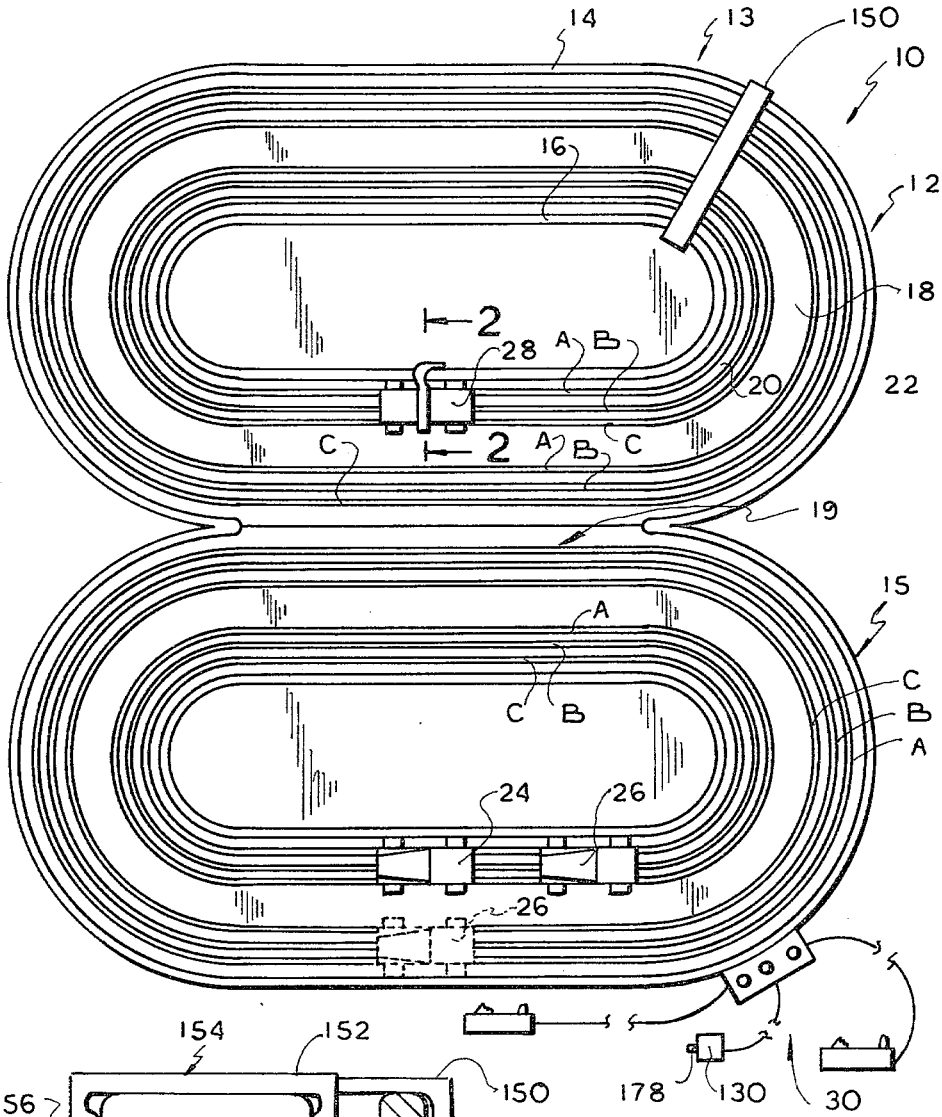
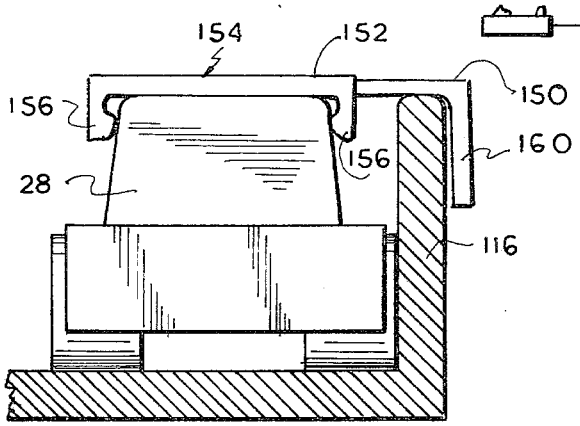
FIG. 2

FIG. 3
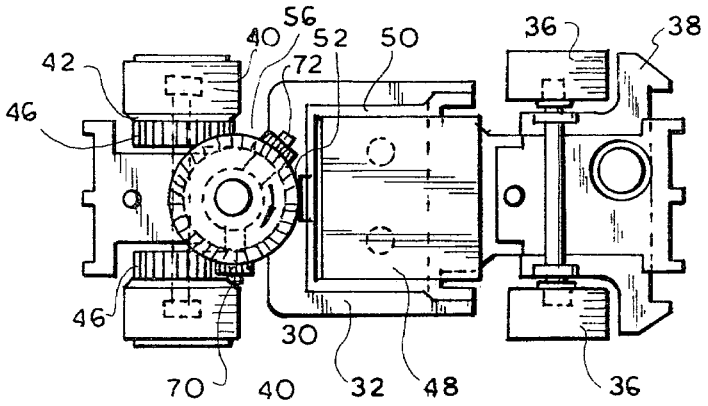
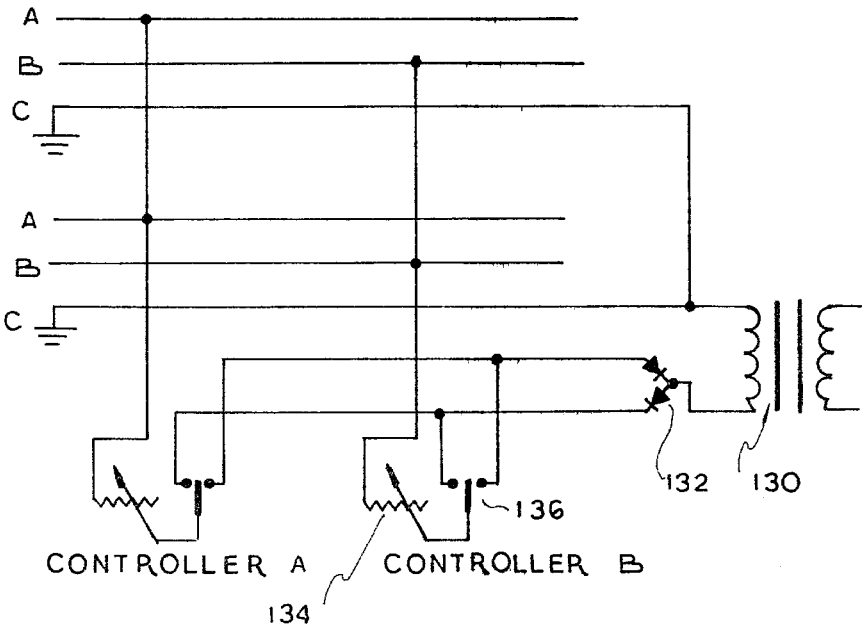
FIG. 4

TOY MINIATURE VEHICLE RACING GAME

The present invention relates to toy vehicle race games and more in particular to a slotless toy vehicle race game in which controllable toy vehicles can switch from one track portion to another portion.

In recent years the advent of commercially feasible slotless racing has occurred in which toy vehicles separately controlled by two or more players can be caused to switch lanes from one lane to another in order to pull out and pass an opponent's vehicle. The first commercially successful slotless race game which provided reliable operation of controllable vehicles is disclosed in U.S. Pat. No. 4,078,799 to Robert G. Lahr. In that game the toy vehicles are steered from one lane to another, between inner and outer side walls, with the use of a control system that is responsive to current polarity reversal. The ability of the toy vehicles to pull out and pass one another creates a very realistic race game and closely simulates the actions of a true automotive race. To further enhance the realism of the race, and to provide an increased degree of difficulty in winning the race, the toy vehicle game disclosed in U.S. Pat. No. 4,078,799 includes a drone or obstacle vehicle which moves along the track at a relatively constant speed. The drone vehicle typically will move in the outer lane of the track, as a result of centrifugal force, and provide an obstacle which must be passed by the controllable toy vehicles.

Heretofore slotless toy vehicle race games consisted of a single track in the general shape of an oval or some other circuitous shape using two or more parallel lanes throughout the game. Thus the toy vehicles were constrained, in effect, to move along a defined path between the sidewalls of the track, although they could switch from one lane to another within the track.

It is an object of the present invention to provide a toy vehicle game wherein the track is provided in two separate track portions defining separate paths of travel and the toy vehicles can move from one track portion to another or stay in a given track path if desired.

Another object of the present invention is to provide a toy vehicle game including two separate paths of travel, in which controllable toy vehicles can be caused to move from one path to another, but in which an obstacle is provided which must be avoided during cross-over.

A further object of the present invention is to provide a toy vehicle game of the character described which is relatively simple in construction and durable in operation.

A still further object of the present invention is to provide an improved toy vehicle game.

Yet another object of the present invention is to provide a toy vehicle game which is relatively simple and economical to manufacture.

In accordance with an aspect of the present invention a toy vehicle race game is provided having at least two tracks or track portions defining separate paths of travel and including a common side. Each of the track portions has spaced inner and outer sidewalls defining at least inner and outer lanes therebetween, except that along at least a portion of the common side there is no outer wall thereon, so that a cross-over portion is defined through which toy vehicles may pass from one path of travel to another. The toy vehicles used in the game include at least one controllable toy vehicle and one drone vehicle. The controllable vehicle or vehicles can be operated by the players to switch lanes within a track portion or path of travel and to cross from one track portion to another at the common track side. The drone vehicle, on the other hand, is constrained for movement in one of the track portions along one of the lanes thereof so as to provide an obstacle to passage of the controllable toy vehicles from one path of travel to another. Thus in order to move between track portions the controllable toy vehicles must be steered in such a way as to avoid collision with the drone vehicle.

The above, and other objects, features and advantages of this invention, will be apparent in the following detailed description of an illustrative embodiment thereof, which is to be read in connection with the accompanying drawings, wherein:

FIG. 1 is a plan view of a toy vehicle game constructed in accordance with the present invention;

FIG. 2 is a sectional view taken along line 2—2 of FIG. 1 showing the constraint arrangement for the drone car;

FIG. 3 is a top plan view of a controllable toy vehicle, with the body removed, used in the present invention;

FIG. 4 is a schematic electrical control diagram of the type of electrical control system which may be used in the toy vehicle game of FIG. 1.

Figure 5:
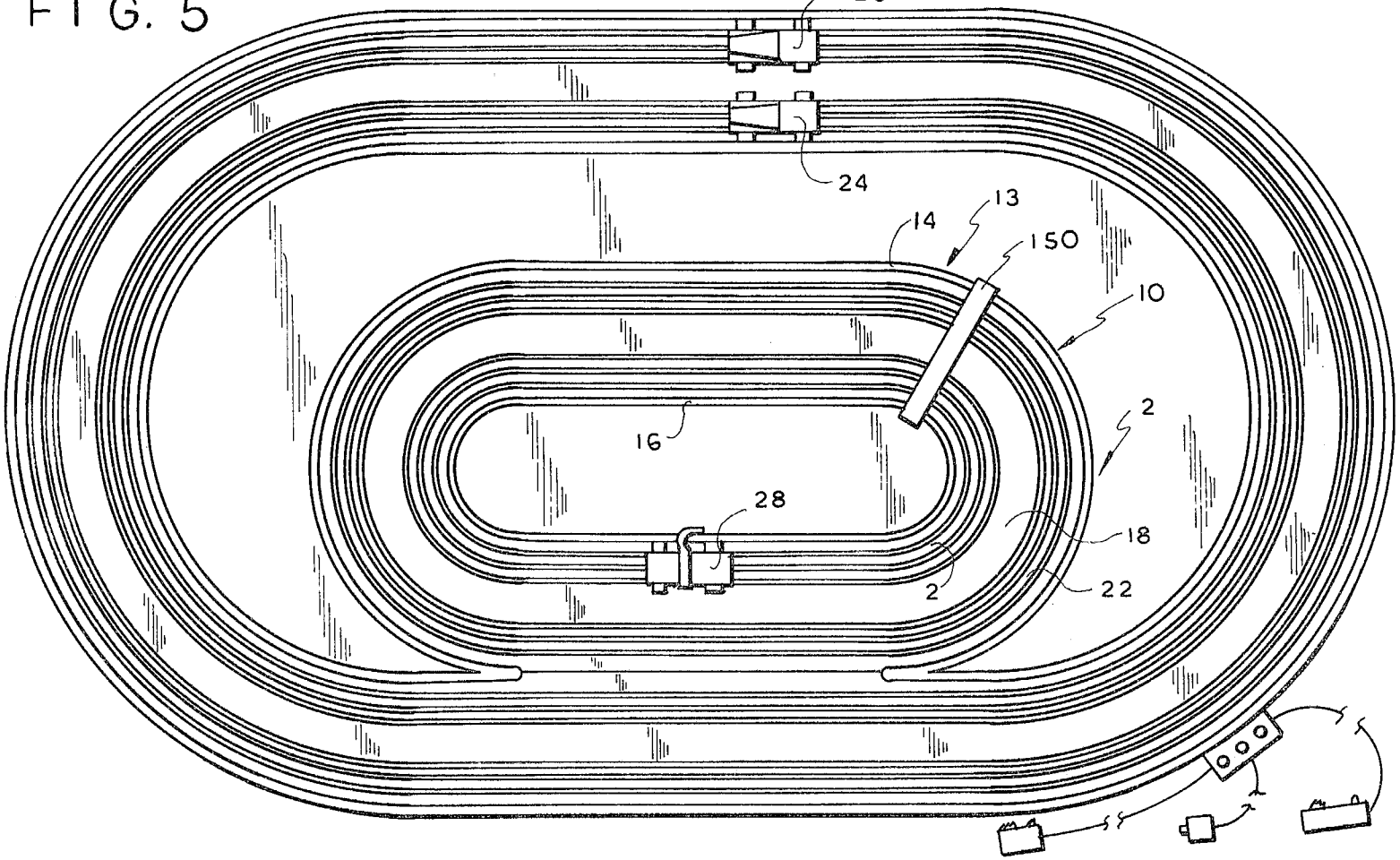
FIG. 5 is a plan view, similar to FIG. 1 to another track layout according to the present invention.

Referring now to the drawing in detail, and initially to FIG. 1 thereof, a toy vehicle game 10, constructed in accordance with the present invention, includes an endless plastic track 12 having a pair of track portions 13, 15, each of which defines a separate path of travel for toy vehicles used in the game. Each track portion has a pair of laterally spaced upstanding sidewalls 14,16 and a road bed or tread surface 18 extending therebetween. Road bed 18 has a width sufficient to define at least two vehicle lanes 20, 22 thereon along which a plurality of vehicles can be operated. Sidewalls 14,16 in each track portion extend substantially entirely around the track portions except where the track portions pass adjacent each other in a cross-over section 19. At this point, no outer walls 16 are provided, so that toy vehicles on the track can pass from one track portion, or path of travel, to the other.

In the illustrative embodiment of the invention the toy vehicle game includes operator controlled vehicles 24,26 which are of substantially identical construction, and in particular are of the type of controllable toy vehicles disclosed in U.S. Pat. No. 4,078,799. In addition, a drone car 28 is provided in one of the track portions. The drone car is adapted to move along its path of travel at a relatively constant speed, and may be battery operated as described in U.S. Pat. No. 4,078,798 or it may accept current from the track, so that its speed varies somewhat with the speed of the controllable vehicles, as described in U.S. Pat. No. 4,141,552. It is understood, however, that the term "relatively constant speed" as used herein is intended to encompass either battery operated toy vehicles as disclosed in U.S. Pat. No. 4,078,798 or current supplied toy vehicles as described in U.S. Pat. No. 4,141,552.

Toy vehicles 24,26 are separately controlled by the players through a control system 30 which enables the players to vary current supplied to the electrical motors in the vehicles, thereby to vary the vehicle speed. The controllers also enable the players to change the polarity of current supplied to the respective vehicle motors whereby the vehicles can be switched by the players from one lane to the other. As mentioned, the controllable vehicles may be identical to the controllable vehicles disclosed in U.S. Pat. No. 4,078,799 or they may be controllable type vehicles for use in slotless race games of other constructions as are presently commercially available.

Essentially, one of the controllable toy vehicles is illustrated schematically in FIG. 3. The vehicle includes a removable body and a pair of front wheels 36 rotatably mounted on the frame in a shock absorbing front end system 38. If desired, the wheels can be canted in one direction or the other, in order to aid in guiding the toy vehicle into biased engagement with the outer sidewalls of the track. The rear wheels 40 of the toy vehicle are rotatably mounted for independent rotation on a shaft 42 rotatably mounted in frame 32.

Power for driving the controllable toy vehicles is supplied from a DC electric motor 48 mounted in the controllable toy vehicle on the frame 32. The electric motor is of conventional DC construction and includes a rotary output shaft 50 connected to the rotor of the motor in the usual manner. A spur gear or output drive element 52 is secured to shaft 50 for rotation thereby. This output member is drivingly engaged with the transmission system 56 that is responsive to the direction of rotation of the output drive element (i.e. the direction of rotation of the output shaft 50 of motor 48, due to the polarity of current supplied to the motor) to selectively drive the drive wheels 40.

The transmission system 56 includes a crown gear 58 and a pair of swing or spur gears 70,72 rotatably mounted on the support shaft for the crown gear, so that, depending upon the direction of rotation of the crown gear, one or the other of the spur gears will be engaged with one or the other of the gears 46 of the rear wheels 40. Thus, one or the other of the rear wheels of the vehicle will be driven depending on the polarity of current supplied to the motor. This selective drive of the rear wheels of the toy vehicle will urge the toy vehicle into one lane or the other on the track, into biased engagement with the adjacent sidewall of the track, as described in U.S. Pat. No. 4,078,799.

Although this type of biasing arrangement for causing the toy vehicle to switch lanes is presently preferred, as mentioned above it is contemplated that other types of steering arrangements for causing the toy vehicles to switch lanes can be provided.

In order to supply current to the toy vehicles, the track surface 18 in each track portion is provided with a plurality of electrical contact strips in each of the lanes 20,22 extending parallel to the sidewalls of the track. In this connection it is noted that in the embodiment of the invention shown in FIG. 1 the track 10 is shown to have a generally figure eight configuration with each track portion 13,15 having a generally oval configuration. However, it is contemplated that the track sections may have other configurations, including irregular configurations as desired. One such alternative embodiment is illustrated in FIG. 5 wherein the track portion 13 is located within track portion 15. This arrangement occupies less total area than the figure eight form but is used in the same way as the embodiment of FIG. 1. Thus corresponding reference numerals have been used to identify the elements in FIG. 5. In any case, each track portion will have its own pairs of current supply strip sets, extending parallel to the sidewalls of that track portion.

In the illustrative embodiments of the invention, each lane in each track portion is respectively provided with three contact strips A, B, and C. The strips are formed of an electrically conductive metallic material and are embedded in the track so that they are substantially flush with the surface of the track and present no obstacle to movement of the vehicles from one lane to the other. Current is supplied to these strips in the manner described in U.S. Pat. No. 4,078,799 and is collected by current collectors mounted on the frame on the controllable toy vehicles, in predetermined locations as described in that patent. The track itself may be constructed in accordance with the teachings of U.S. Pat. No. 4,106,695. And, the adjacent track sections in the cross-over 19 may be secured together in any convenient manner, so that track portions 13,15 do not separate when in use. This can be done, for example, by bolts or clips connected between the track sections on the lower surface thereof in the area of the cross-over 19.

The contact strips in each lane in each track portion are paired with each other. That is, all of the A strips in every lane in both track portions are electrically connected to each other, as are all of the B strips and all of the C strips. The C strips are connected to electrical ground and the A and B strips are provided to separately supply current and control polarity of the current to the respective vehicles, so that two vehicles can operate in the same lane and still be separately controlled. For this reason, the current collectors on the vehicles are arranged to associate the respective vehicles with only one of the pairs of contact strips. For example, vehicle 24 will obtain current from strips B while vehicle 26 will obtain current from strips A.

The control system for the controllable toy vehicles is described in detail in U.S. Pat. No. 4,078,799 and illustrated schematically in FIG. 4. The control system essentially includes respective controllers A and B by which the players can control the vehicles 24,26 respectively. The control system further includes a plug 128 by which the system can be connected to an electrical AC power source, and a transformer 130. Power is supplied from the transformer 130 through a half-wave rectifier 132 including two diodes connected as shown to separately supply current to the controllers A, B. Each controller is provided as a hand held unit and includes a variable resistor 134 operated as a trigger on the unit, as well as a single pole, double throw switch 136. Current from controller B is supplied through its variable resistor 134 to the contact strips B and current from the controller A is supplied through its variable resistor to the contact strips A. The variable resistors may be of any convenient construction to permit the operators to vary the current supplied to their respective contact strips, and thus their respective vehicles in order to vary the speed of the vehicles.

The polarity of the current supplied to the toy vehicles is separately and independently controlled by the switches 136 so that the polarity of the current supplied to the motors of the respective vehicles, as controlled by the respective controllers, will vary in accordance with the position in which the switches are placed. By this arrangement, each player using his controller can control the speed of his vehicle along track 12 and he can also variably position his vehicle along the track simply by changing the polarity of current supplied to the vehicle. As described above and in U.S. Pat. No. 4,078,799 this will determine which lane the vehicle will be driven to.

Although a specific type of control system has been described herein, it is contemplated that other types of control systems such as are presently commercially available, including the control system used in the Total Control Racing Game sold by Ideal Toy Corporation can also be used in the present invention.

By this arrangement, it will be appreciated that the controllable toy vehicles 24,26 can be controlled to pull out and pass one another in either track portion by causing the vehicles to change position from one lane to the other. In accordance with the present invention, however, an improved race game is provided in that the two separate track portions 13,15 and the paths of travel they define are located adjacent each other with a cross-over section therebetween, to enable the toy vehicles to change position from one path of travel to another, as well as change lanes within a track portion. Thus for example, if the player operating controllable toy vehicle 26 wishes to cause the toy vehicle to move into the track portion 13 from the track portion 15, he would operate his controller to cause the toy vehicle to be biased to the left, so that once it is free of the outer wall 14 of track portion 15, it would move into track portion 13. On the other hand, if the player wanted to keep the toy vehicle within track portion 15, he would operate his controller as the toy vehicle approaches the cross-over point 19 to bias the vehicle to the right towards the inner wall 16 of the track thus preventing the toy vehicle from moving into track portion 13. Of course the controllable toy vehicle 24 would be operated in a similar manner. By this arrangement, the toy vehicles can be caused to selectively operate in either track portion, and to move from one path of travel to the other as desired.

In order to provide a race game in which the toy vehicles are required to move from one track portion or path of travel to the other, one of the track portions, for example the track portion 13, may be provided with a conventional lap counter 150. The lap counter can be of any convenient construction in order to enable it to discriminate between the toy vehicles 24,26 and provide an indication of the number of times a particular toy vehicle has passed the counter station. With this arrangement, a toy vehicle game can be provided in which to win the game the toy vehicles will be required to accumulate a given number of laps.

To render the play of the game more difficult, and thereby improve the play value of the game, a drone vehicle 28 is provided. In the usual slotless race game, such as disclosed in U.S. Pat. No. 4,078,799, the drone vehicle simply provides an obstacle along the track which must be passed by the players during the play of the game. This drone vehicle forces the players to operate their controllable vehicles to pass the drone, which usually occupies the outer lane due to the effects of centrifugal force. The drone thus eliminates the effects of manufacturing differences between the toy vehicles on the controllable toy vehicles' speed. The drone vehicle used in accordance with the present invention serves the same function but, in addition, serves as an obstacle to movement of the toy vehicles through the cross-over 19.

In accordance with the present invention, the drone vehicle is constrained to move along the inner wall 16 of the track portion 13. This is done by the provision of a clip 152 formed on a resilient plastic material. The clip includes a first end portion 154 having legs 156 that can frictionally engage the sides of the drone vehicle to hold the clip connected thereto. An additional section 158 of the clip extends laterally of the toy vehicle and includes a leg 160 which overhangs the inner sidewall 16 of the track in a sliding relation, thereby to hold the drone vehicle in the inner lane of the track. Preferably the drone vehicle is arranged so that it moves in a direction opposite to the direction of the controllable vehicles, although that is not a requirement of the game.

With this arrangement, during the play of the game, when a toy vehicle in track portion 15 must cross into the track portion 13, in order to pass the lap counter 130, the cross-over of the vehicle must be timed by the player in order to avoid collision with the drone vehicle 28 on the inner lane of track portion 13. Such a collision would knock the car out of the game, or at least slow it down, permitting the player's competitor to gain additional laps while the collision is repaired. Thus, for example, a player controlling the controllable vehicle 26, when approaching the cross-over 19, must gauge the location of the drone vehicle 28, to determine whether he will collide with the drone vehicle if he permits his toy vehicle to enter the track portion 13. If the player feels that he will collide with the drone vehicle, he must then operate his controller to try and keep the controllable vehicle in track portion 15, as by steering the vehicle towards the inner wall 16 of that track section. This is possible but difficult to do and requires skill, because the effects of centrifugal force of the toy vehicle coming out of the curve will tend to move the toy vehicle into track portion 13 through cross-over 19. Thus the player must not only control steering of the vehicle but speed as well to overcome the centrifugal force effects. The toy vehicle will then remain in track portion 15 and hopefully in the next pass through the track, can enter track portion 13 without danger of collision with the drone vehicle.

If the player decides that he can attempt a cross-over into the track portion 13, he will typically steer the toy vehicle to the left, so that it will pass over the cross-over into track portion 13. Steering the controllable vehicle to the left, in the illustration at FIG. 1 will however typically cause the toy vehicle to move into the inner lane of track portion 13, the very lane in which the drone car is located. Thus, the player must attempt to steer the vehicle out at the inner lane into the outer lane to avoid a head-on collision with the drone car. With a sufficient degree of skill, the player could however steer the vehicle to the left as it approaches the cross-over from the track portion 15, and then cause biasing of the vehicle to the right as it enters track portion 13 and passes over the current supply strips of lane 22 to steer the vehicle immediately to the right and engage the outer wall of track portion 13 to hold the vehicle in the outer lane and avoid totally any possibility of colliding with the drone vehicle 28.

Accordingly, it is seen by the arrangement of the present invention a toy vehicle game is provided which has substantial play value and requires the players to exercise elements of judgment, skill and dexterity in controlling the toy vehicles to pass from one track section to another in order to accumulate the necessary laps required to win the game while avoiding collisions with the drone vehicles.

Although an illustrative embodiment of the invention has been described herein with reference to the accompanying drawings it is to be understood that the invention is not limited to that precise embodiment, and that various other changes and modifications may be effected therein by one skilled in the art without departing from the scope of spirit of this invention.

What is claimed is:

1. A toy vehicle race game comprising a relatively flat slotless track having at least two track portions having a common side and defining separate paths of travel, each of said track portions having spaced inner and outer side walls defining at least an inner and outer lane therebetween except that along at least a portion of said common side the track portions have no outer wall whereby toy vehicles may pass from one path of travel to another, a plurality of toy vehicles including at least one controllable toy vehicle and one drone vehicle, means for controlling the controllable toy vehicle to switch lanes and cross from one path of travel to another at said common track side, and means for constraining movement of said drone vehicle to one of said track portions along one wall thereof whereby the controllable toy vehicle must be controlled to move from one track portion to another without colliding with said drone vehicle.

2. A toy vehicle race game as defined in claim 1 wherein said track portions are generally oval and have a common side that is at least four lanes wide, whereby said track has the general shape of a figure eight.

3. A toy vehicle race game as defined in claim 1 wherein said constraining means comprises clip means mounted on said drone car and slidably engaged with the inner side wall along which it moves.

4. A toy vehicle race game as defined in claim 3 wherein said clip means is removably mounted on said drone car.

5. A toy vehicle race game as defined in claim 1 including means for driving said drone vehicle about the track at a relatively constant speed.

6. A toy vehicle race game as defined in claim 1 including a pair of independently operable controllable toy vehicles and means for separately controlling said controllable toy vehicles to switch lanes and cross from one path of travel to another at said common track side.

7. A toy vehicle race game as defined in claim 6 including lap counter means in said track portion containing the drone vehicle for monitoring the passage of said controllable vehicles through that track section.

8. A toy vehicle race game as defined in claim 7 wherein said controllable toy vehicles include means for causing the vehicles to switch lanes in response to reversal of current polarity supplied to the vehicle and said controlling means comprises a plurality of electrically continuous current supply contacts extending along each of the lanes in each track portion, means for separately controlling current flow to at least two contacts in each lane and means on each of said vehicles for electrically associating the vehicle with only one of said at least two contacts, with each vehicle being associated with a different one of said at least two contacts.

9. A toy vehicle race game as defined in claim 8 wherein each of said current supply contacts in each lane is electrically connected to a corresponding contact in each other lane of the pair of track portions whereby the controllable toy vehicles can be separately controlled regardless of which lane or track portion it is in.

10. A toy vehicle race game as defined in claim 1 wherein said drone vehicle is positioned on the track to move in a direction opposite to said controllable vehicles.

11. A toy vehicle race game comprising a relatively flat slotless track having at least two track portions each having separate inner and outer lanes defining separate paths of travel, said track sections including unobstructed cross-over sections located adjacent each other defining a cross-over being at least four lanes wide through which toy vehicles may pass from one track section to another, a pair of controllable toy vehicles, means for selectively and independently controlling the controllable toy vehicles to cause them to switch lanes within a track portion and at said cross-over thereby to pass one another and cross from one path of travel to another; a drone vehicle and means for restraining the drone vehicle for movement in one of the lanes of one track portion thereby to provide an obstacle to vehicles crossing into said one track portion.

12. A toy vehicle race game as defined in claim 11 wherein said drone vehicle is constrained to move in the inner lane of said one track portion.

13. A toy vehicle race game as defined in claim 12 wherein said one track portion has an inner wall extending parallel to the inner lane of said one track portion and said restraining means comprises means mounted on the drone vehicle and slidably engaged with said wall.

14. A toy vehicle race game as defined in claim 13 wherein said restraining means is a clip removably mounted on said drone car.

15. A toy vehicle race game as defined in claim 11 including lap counter means in said track portion containing the drone vehicle for monitoring the passage of said controllable vehicles through that track portion.

16. A toy vehicle race game as defined in claim 11 wherein said drone vehicle is positioned on the track to move in a direction opposite to said controllable vehicles.

* * * * *